US008894138B2

(12) United States Patent
Monahan

(10) Patent No.: US 8,894,138 B2
(45) Date of Patent: Nov. 25, 2014

(54) COLLAPSIBLE MOBILE FURNITURE FRAME

(75) Inventor: Dustin Monahan, New York, NY (US)

(73) Assignee: Better Off Clever LLC, Twin Mountain, NH (US)

( * ) Notice: Subject to any disclaimer, the term of this patent is extended or adjusted under 35 U.S.C. 154(b) by 315 days.

(21) Appl. No.: 13/411,031

(22) Filed: Mar. 2, 2012

(65) Prior Publication Data

US 2013/0229032 A1 Sep. 5, 2013

(51) Int. Cl.
*A47C 4/00* (2006.01)

(52) U.S. Cl.
USPC ..... 297/44; 297/234

(58) Field of Classification Search
CPC ..... B60N 2/20; A47C 4/02; A47C 13/005; A47C 4/52; A47C 9/08; A47C 1/124; A61G 5/08
USPC ..... 297/378.1, 440.1, 440.14, 440.15, 44, 297/42, 232, 233, 234, 235, 248, 17
See application file for complete search history.

(56) References Cited

U.S. PATENT DOCUMENTS 583,136 A * 5/1897 Anderson ..... 5/26.1
863,874 A * 8/1907 Rajner ..... 297/115
1,335,973 A * 4/1920 Kesselman ..... 297/107
1,738,473 A * 12/1929 Green ..... 297/45
1,817,708 A * 8/1931 Pintow ..... 297/110
1,926,915 A * 9/1933 Ramirez ..... 297/109
2,043,669 A * 6/1936 Liska ..... 297/187
2,053,349 A * 9/1936 Nordmark ..... 297/116
2,116,366 A * 5/1938 Scott ..... 297/43
2,621,708 A * 12/1952 Luce, Jr. ..... 297/117
2,790,485 A * 4/1957 Franklin ..... 297/116
3,001,822 A 9/1961 Pagliaro et al.
3,093,410 A * 6/1963 Wilson ..... 297/119
3,635,521 A * 1/1972 Shivvers ..... 297/125
3,722,952 A 3/1973 Novitzky
3,873,114 A * 3/1975 Brown ..... 280/30
3,947,903 A * 4/1976 Menke ..... 5/111
4,234,976 A 11/1980 Litkewycz
4,523,787 A 6/1985 Robinson
4,632,459 A 12/1986 Herschlag
4,697,847 A 10/1987 Herschlag
4,742,900 A * 5/1988 Boxhammer ..... 190/2
4,989,915 A * 2/1991 Hansal ..... 297/378.1
5,570,928 A * 11/1996 Staunton et al. ..... 297/232
5,630,644 A * 5/1997 LaPointe et al. ..... 297/232
5,647,632 A * 7/1997 Fireman ..... 297/109
6,231,119 B1 * 5/2001 Zheng ..... 297/16.2
(Continued)

*Primary Examiner* — David R Dunn
*Assistant Examiner* — Alexander Harrison
(74) *Attorney, Agent, or Firm* — Pergament Gilman & Cepeda LLP

(57) ABSTRACT

A collapsible mobile furniture frame is provided that includes a center frame, a left frame and a right frame. The left and right frames each include a seat base and a seat back. The left and right seat backs are pivotally connected to the left and right seat bases, respectively, such that the left and right seat backs are capable of pivoting downwardly to a collapsed position against the left seat base. Likewise, the right seat back is pivotally connected to the right seat base by right back hinges such that the right back is capable of pivoting downwardly about the right back hinges to a collapsed position against the right seat base. The left and right frames are pivotally connected to the center seat base such that they are capable of pivoting upwardly to a collapsed position against the center seat base.

11 Claims, 3 Drawing Sheets

(56) References Cited

U.S. PATENT DOCUMENTS

| | | | | |
|---|---|---|---|---|
| 6,824,220 | B1 * | 11/2004 | Davison | 297/440.14 |
| 7,070,230 | B2 * | 7/2006 | Chen | 297/135 |
| 7,093,904 | B1 * | 8/2006 | McMillen | 297/411.37 |
| 7,267,403 | B2 * | 9/2007 | Conner | 297/217.7 |
| 7,370,914 | B2 | 5/2008 | Newman | |
| 7,448,689 | B2 * | 11/2008 | Carter et al. | 297/440.14 |
| 7,490,896 | B2 * | 2/2009 | Smith | 297/235 |
| 7,497,514 | B2 * | 3/2009 | Ramsey et al. | 297/234 |
| 7,922,253 | B2 | 4/2011 | Chen | |
| 8,033,604 | B2 * | 10/2011 | Behrens et al. | 297/236 |
| 2005/0225153 | A1 | 10/2005 | Ou | |
| 2005/0253430 | A1 * | 11/2005 | George et al. | 297/248 |

* cited by examiner

COLLAPSIBLE MOBILE FURNITURE FRAME

FIELD OF THE INVENTION

The present invention relates to furniture frames, and more particularly, to furniture frames capable of collapsing to a smaller size for the purpose of facilitating relocation.

BACKGROUND OF THE INVENTION

Conventional sitting furniture for living room spaces typically comprises furniture that can accommodate more than one person sitting thereon, such as sofas, couches, sectionals, loveseats and daybeds. Such sitting furniture is typically large, heavy and bulky, and as a result does not lend itself well to being easily relocated. This can create logistical problems for furniture owners when they move their furniture from room to room or from one home to another, as such furniture may need to be moved through a narrow space, such as a doorway or hallway of an old building, an elevator, or a stairwell.

In some cases, these narrow spaces are narrow enough to physically prevent entry by the furniture without making physical changes to the furniture or the space. In such circumstances, the owner may have to resort to either disassembling or cutting away portions of the furniture to allow the furniture to fit through, deforming portions of the narrow space to accommodate the size and shape of the furniture, or abandoning or selling the furniture altogether. Each of these instances invites increased costs to repair or replace the furniture or narrow space.

SUMMARY OF THE INVENTION

In view of the foregoing, a collapsible mobile furniture frame is provided. The furniture frame includes a center frame, a left frame that is located laterally adjacent to the center frame on one side, and a right frame that is located laterally adjacent to the center frame on the opposite side. The center frame includes a center seat base and a center seat back, the left frame includes a left seat base and a left seat back, and the right frame includes a right seat base and a right seat back. The left seat back is pivotally connected to the left seat base by left back hinges such that the left seat back is capable of pivoting downwardly about the left back hinges to a collapsed position against the left seat base. Likewise, the right seat back is pivotally connected to the right seat base by right back hinges such that the right back is capable of pivoting downwardly about the right back hinges to a collapsed position against the right seat base. The left seat base is pivotally connected to the center seat base by left central hinges such that the left frame is capable of pivoting upwardly about the left central hinges to a collapsed position against the center seat base. Likewise, the right seat base is pivotally connected to the center seat base by right central hinges such that the right frame is capable of pivoting upwardly about the right central hinges to a collapsed position against the center seat base. When in an uncollapsed position, the furniture frame can be upholstered with a slip cover and adorned with cushions and pillows to give the appearance of a conventional sofa. The furniture frame can also be upholstered when in a collapsed position.

BRIEF DESCRIPTION OF THE DRAWINGS

For a more complete understanding of the present invention, reference is made to the following detailed description of an embodiment considered in conjunction with the accompanying drawings, in which.

DETAILED DESCRIPTION OF THE INVENTION

Figure 1:
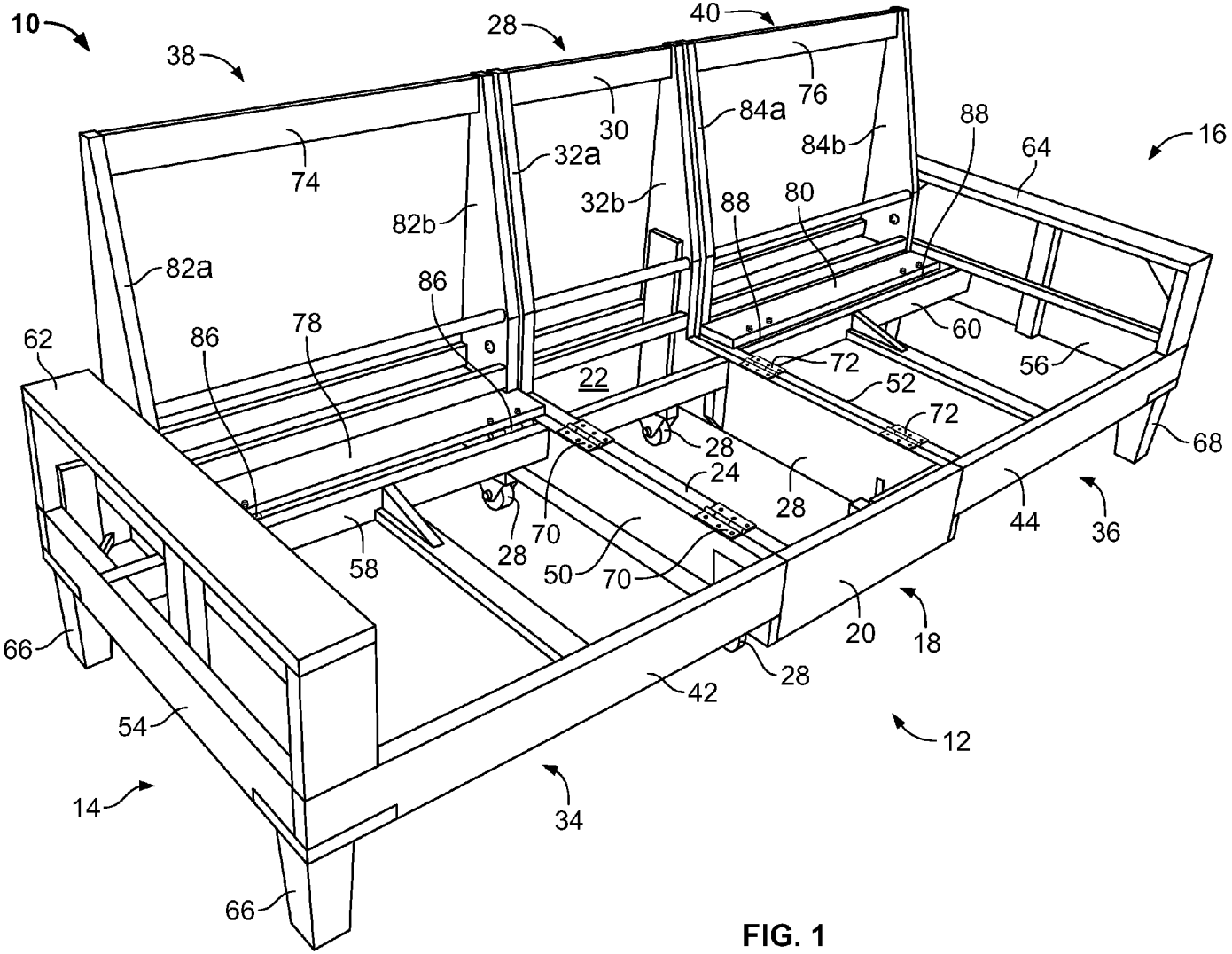
FIG. 1 is a front perspective view of a furniture frame constructed in accordance with an embodiment of the present invention.
Figure 2:
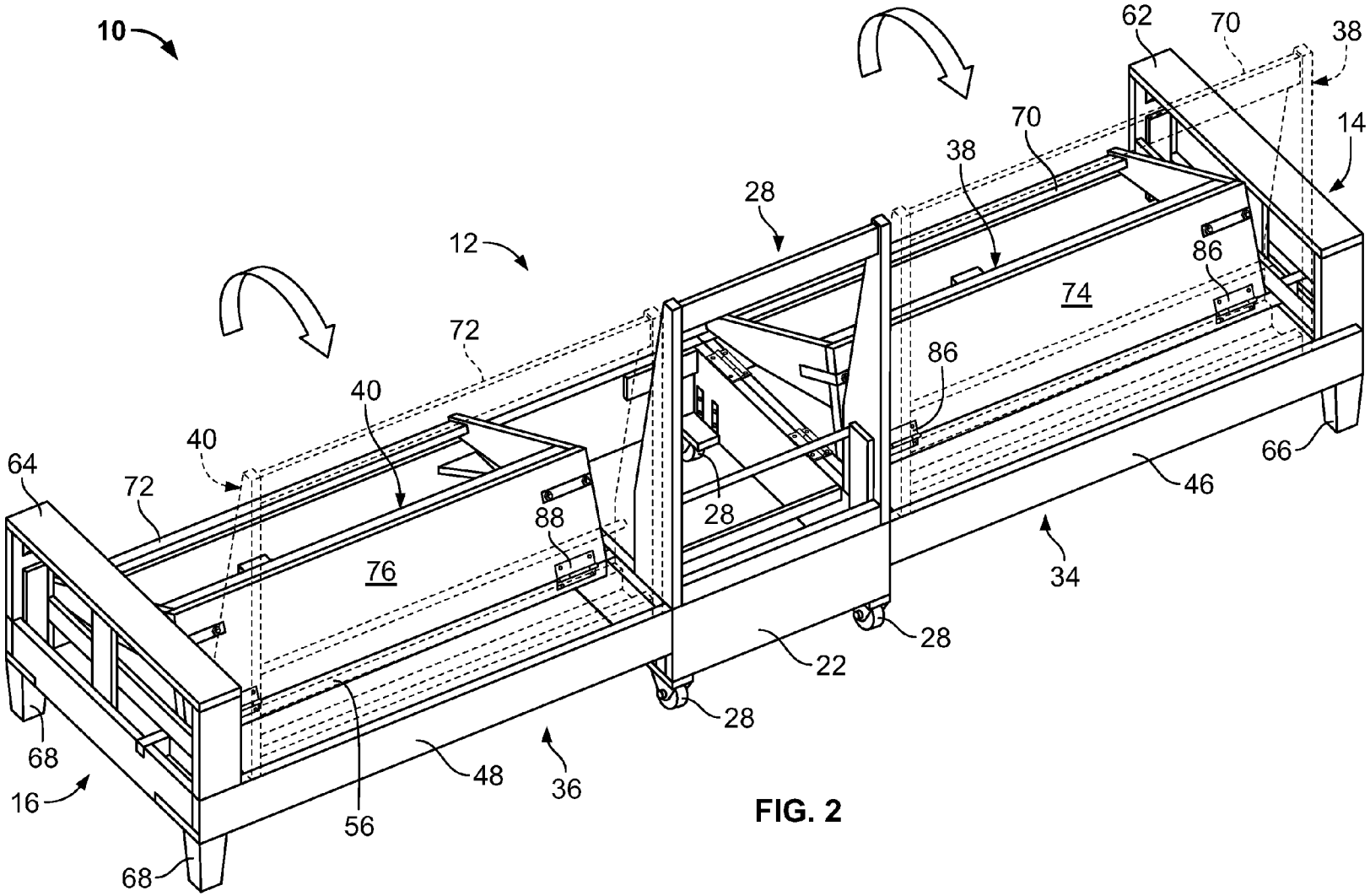
FIG. 2 is a back perspective view of the furniture frame shown in FIG. 1 with the left and right seat backs shown in a collapsed position, the uncollapsed positioning of the left and right seat backs being displayed in phantom.
Figure 3:
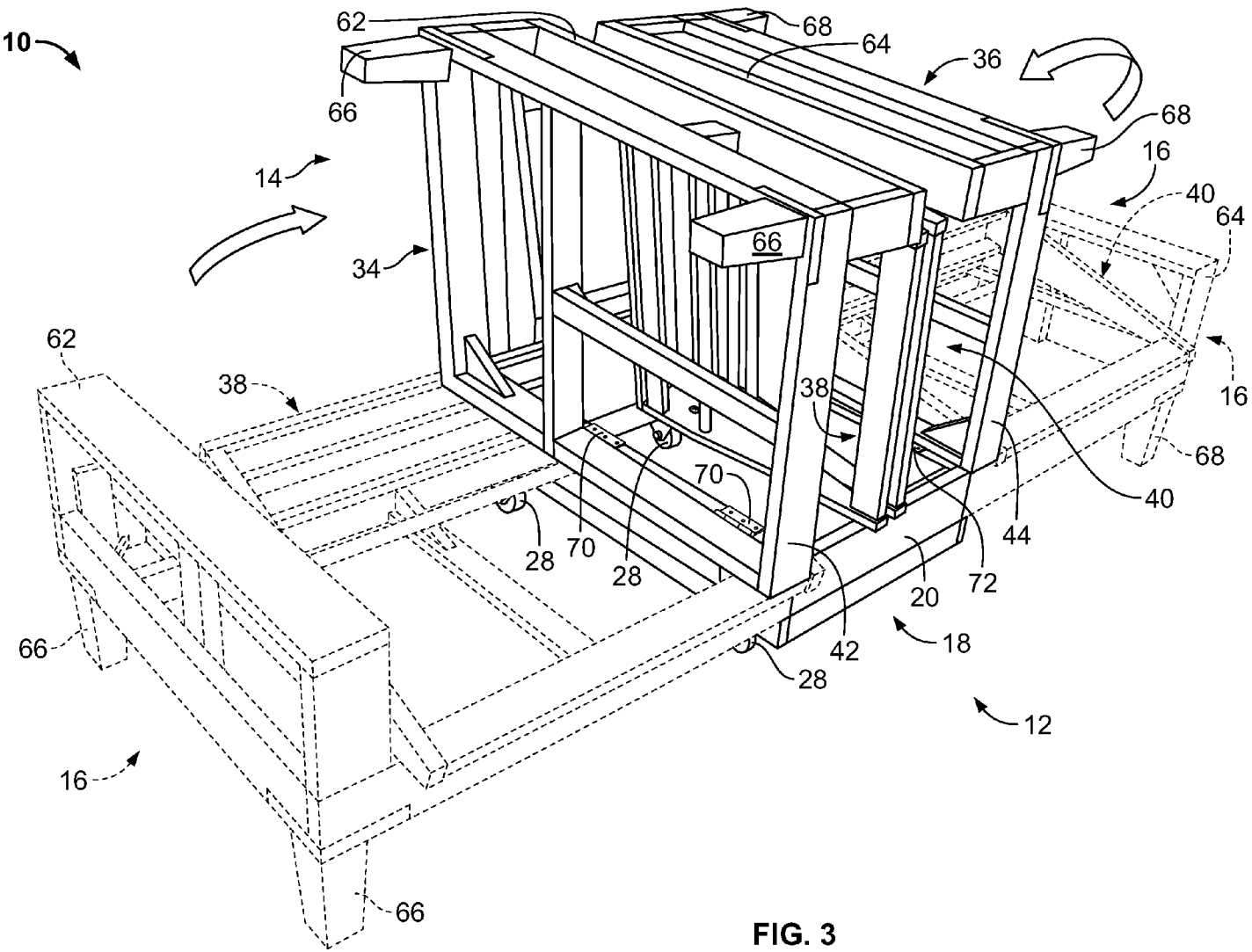
FIG. 3 is a front perspective view of the furniture frame shown in FIG. 2 with the left and right frames shown in a collapsed state, the uncollapsed positioning of the left and right frames shown in FIG. 2 being displayed in phantom.

FIGS. 1-3 illustrate a furniture frame 10 constructed in accordance with an embodiment of the present invention. With reference to FIG. 1, the furniture frame 10 includes a center frame 12, a left frame 14 that is pivotally connected to one side of the center frame 12, and a right frame 16 that is pivotally connected to the opposing side of the center frame 12. The center frame 12 has a rectangularly-shaped center seat base 18, which is defined by a center front rail 20, a center back rail 22 located parallel to the center front rail 20, and left and right side rails 24, 26 that connect the center front rail 20 and the center back rail 22 at opposite ends. A plurality of wheels 28 are attached to the underside of the center seat base 18 to ease the ability of the frame 10 to be moved from one place to another, as will be discussed in greater detail below.

The center frame 12 also includes a center seat back 30 that is fixedly attached to the rear portion of the center seat base 18 (i.e., proximate to the center back rail 22). The center seat back 30 has a center upper rail 32, which defines the top edge of the furniture frame 10, and shaped central side boards 34*a*, 34*b* that are attached to opposite ends of the center upper rail 32 and are rigidly fixed to the left and right side rails 24, 26 of the center seat base 18. The center seat back 30 is sized and shaped to provide support for a user's back when the furniture frame 10 is in use as a sofa, love seat or similar piece of sitting furniture.

The left frame 14 and the right frame 16 are oriented on either side of the center frame 12 and are constructed to be mirror images of each other. Accordingly, each of the left and right frames 14, 16 has a seat base (see left and right seat bases 34, 36) and a seat back (see left and right seat backs 38, 40). Each of the left and right seat bases 34, 36 is defined by a front rail (see left and right front rails 42, 44), a back rail located parallel and opposite to the front rail (see left and right back rails 46, 48 in FIG. 2), an inner side rail located proximate to the center frame 12 and extending between the front and back rails (see left and right inner side rails 50, 52), and an outer side rail located opposite to the inner side rail and extending between the front and back rails (see left and right outer side rails 54, 56). The left and right seat bases 34, 36 also include left and right support rails 58, 60 located substantially parallel and proximate to the left and right back rails 46, 48, respectively. The left and right support rails 58, 60 support the structural stability of the left and right seat bases 34, 36 and establish points of connection between the left and right seat bases 34, 36 and the left and right seat backs 38, 40, respectively, as will be discussed in further detail below. The left and right seat bases 34, 36 also include left and right arm rests 62, 64 attached to the upper ends of the left and right outer side rails 54, 56, respectively, and left and right furniture legs 66, 68 attached to the lower ends of the left and right outer side rails 54, 56, respectively.

The top surface of the left inner side rail 50 of the left frame 14 is pivotally connected to the top surface of the left side rail 24 of the center frame 12 by way of one or more left central hinges 70. Likewise, the top surface of the right inner side rail 52 of the right frame 16 is pivotally connected to the top surface of the right side rail 26 of the center frame 12 by way of one or more right central hinges 72. The left and right central hinges 70, 72 allow the left frame 14 and right frame 16 to pivot about the axes created by the left and right central hinges 70, 72, respectively, thereby allowing the left and right frames 14, 16 to collapse upwardly and inwardly toward the center frame 12, as will be discussed in further detail below.

Still referring to FIG. 1, the left and right seat backs 38, 40 each have an upper rail that is aligned with the center upper rail 30 of the center seat back 28 (see left and right upper rails 74, 76), a lower plank that defines the bottom portion of the seat back (see left and right lower planks 78, 80) and shaped side boards that connect the upper rail to the lower plank (see left and right side boards 82*a*, 82*b*, 84*a*, 84*b*). The left and right side boards 82*a*, 82*b*, 84*a*, 84*b* are sized and shaped to match the size and shape of the central side boards 32*a*, 32*b*, while the left and right upper rails 74, 76 and left and right lower planks 78, 80 extend the substantial length of the left and right back rails 46, 48, respectively. The left and right lower planks 78, 80 rest on the left and right back rails 46, 48 of the left and right seat bases 34, 36, respectively, and are pivotally connected to the left and right support rails 58, 60, respectively, via one or more hinges (i.e., left and right back hinges 86, 88). The left and right back hinges 86, 88 allow the left and right seat backs 38, 40 to pivot about the axes created by the left and right back hinges 86, 88, respectively, thereby allowing the left and right seat backs 38, 40 to collapse downwardly toward the left and right seat bases 34, 36, as will be discussed further below.

FIGS. 2 and 3 illustrate a method of collapsing the furniture frame 10 in accordance with an embodiment of the present invention. Referring to FIG. 2, the left and right seat backs 38, 40 are first moved to a collapsed position against the left and right seat bases 34, 36, respectively. Accordingly, the left seat back 38 is pivoted about the left back hinges 86 toward the left front rail 42 such that the left upper rail 74 is substantially adjacent to the left front rail 42. Likewise, the right seat back 40 is pivoted about the right back hinges 88 toward the right front rail 44 such that the right upper rail 76 is substantially adjacent to the right front rail 44. Doing so lifts the left and right lower planks 74, 76 away from the left and right back rails 46, 48 and creates sufficient horizontal clearance between the center seat back 28 and the left and right lower planks 74, 76 to allow the left and right frames 14, 16 to collapse upwardly without obstruction.

Referring to FIG. 3, with the left and right seat backs 38, 40 in a collapsed position, the left and right frames 14, 16 are moved to a collapsed position against the center frame 12. Accordingly, with the left seat back 38 in a collapsed position, the left seat base 34 is rotated upwardly and about the left central hinges 70 in a clockwise motion toward the center frame 12 such that the left seat back 38 is adjacent to the center seat base 18. Likewise, with the right seat back 40 in a collapsed position, the right seat base 36 is rotated upwardly and about the right central hinges 72 in a counterclockwise motion toward the center frame 12 such that the right seat back 40 is adjacent to the center seat base 18. As a result, the left and right seat bases 34, 36 are elevated and repositioned substantially above the center seat base 18, with the left seat back 38 located substantially adjacent to the right seat back 40. With the left and right frames 14, 16 in their respective collapsed positions, the furniture frame 10 is now in a collapsed state and can be moved around using the wheels 28 located underneath the center frame 12. One can return the furniture frame 10 to its uncollapsed state by executing the foregoing steps in reverse.

The present invention provides a number of benefits and advantages. For instance, the collapsible nature of the furniture frame 10 allows it to navigate narrower spaces without creating moving complications. In addition, the wheels 28 underneath the center frame 12 allow the furniture frame 10 to be moved without requiring heavy lifting or the need for a moving apparatus, such as a hand truck or a dolly. Furthermore, the structure of the furniture frame 10 gives the appearance of a conventional piece of sitting furniture and allows the owner to conceal the collapsible nature of the furniture frame 10 when in use in a sitting space.

While FIGS. 1-3 illustrate one embodiment of the invention, many variations of this embodiment can be implemented while staying within the scope and spirit of the invention. For instance, in one embodiment, the left and right central hinges 70, 72 are decouplable to allow the left and right frames 14, 16 to detach from the center frame 12, thereby giving the furniture frame 10 greater mobility in that each of the center, left and right frames 12, 14, 16 can be moved separately from one space to another. In another embodiment, the left and right legs 66, 68 are detachable from the left and right frames 14, 16, respectively, to allow the furniture frame 10 in its collapsed position to occupy less lateral space, thereby allowing it to move through narrower doorways or corridors.

In the embodiment shown in FIGS. 1-3, each of the rails that comprise the center, left and right seat bases 18, 34, 36 of the furniture frame 10 is rigid and substantially inflexible. This construction allows the furniture frame 10 to substantially maintain the durability of a conventional, non-collapsible furniture frame. Alternatively, each of these rails can be flexible or have movable joints to allow for increased collapsibility of the furniture frame 10.

While FIGS. 1-3 show a furniture frame 10 in the shape of a three-person sofa, the present invention can also be embodied in a two-person loveseat, a larger sectional couch, or a daybed. In addition, the wheels 28 underneath the center frame 12 can be substituted for other mechanisms suitable for moving objects, such as frictionless sliders. Furthermore, while the furniture frame 10 is shown with left and right arm rests 58, 60, another embodiment of the present invention may include no arm rests.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A furniture frame comprising:

a center frame including a center seat base and a center seat back, said center seat back being rigidly fixed to said center seat base;

a left frame located laterally adjacent to said center frame and including a left seat base and a left seat back, said left seat back being pivotally connected to said left seat base by at least one left back hinge such that said left seat back is capable of pivoting downwardly about said at least one left back hinge to a collapsed position against said left seat base, and said left seat base being pivotally connected to said center seat base by at least one left central hinge such that said left frame is capable of pivoting upwardly about said at least one left central hinge to a collapsed position against said center seat base; and a right frame located laterally adjacent to said center frame opposite said left frame and including a right seat base and a right seat back, said right seat back being pivotally connected to said right seat base by at least one right back hinge such that said right back is capable of pivoting downwardly about said at least one right back hinge to a collapsed position against said right seat base, and said right seat base being pivotally connected to said center seat base by at least one right central hinge such that said right frame is capable of pivoting upwardly about said at least one right central hinge to a collapsed position against said center seat base.

2. The furniture frame of claim 1 further comprising a plurality of wheels connected to the underside of said center frame.

3. The furniture frame of claim 1 further comprising a plurality of sliders connected to the underside of said center frame.

4. The furniture frame of claim 1, wherein said left seat base of said left frame includes at least one left leg located underneath said left seat base, and said right seat base of said right frame includes at least one right leg located underneath said right seat base.

5. The furniture frame of claim 4, wherein said at least one left leg is detachable from said left seat base of said left frame, and said at least one right leg is detachable from said right seat base of said right frame.

6. The furniture frame of claim 5, wherein said left seat base of said left frame includes a left arm rest located distal from said at least one left center hinge and said right seat base of said right frame includes a right arm rest located distal from said at least one right center hinge.

7. The furniture frame of claim 1, wherein said left frame and said right frame are detachable from said center frame.

8. The furniture frame of claim 1, wherein said left seat base includes a rigid left front rail and a rigid left back rail substantially parallel to said left front rail, and said right seat base includes a rigid right front rail and a rigid right back rail substantially parallel to said right front rail.

9. The furniture frame of claim 8, wherein said left front rail and said left back rail extend the lateral length of said left frame, and said right front rail and said right back rail extend the lateral length of said right frame.

10. The furniture frame of claim 9, wherein said left seat base includes a rigid left inner rail located adjacent to said center frame and connecting said left front rail and said left back rail, and said right seat base includes a rigid right inner rail located adjacent to said center frame and connecting said right front rail and said right back rail.

11. A method of collapsing a furniture frame having a center frame, a left frame and a right frame, the center frame being located between the left frame and the right frame and including a center seat base and a center seat back, the center seat back being rigidly fixed to said center seat base, the left frame being pivotally connected to the center frame by at least one left central hinge and including a left seat base and a left seat back that is pivotally connected to the left seat base by at least one left back hinge, and the right frame being pivotally connected to the center frame by at least one right central hinge and including a right seat base and a right seat back that is pivotally connected to the right seat base by at least one right back hinge, the method comprising the steps of:

pivoting the left seat back downwardly toward the left seat base to a collapsed position such that the left seat back is against the left seat base;

pivoting the right seat back downwardly toward the right seat base to a collapsed position such that the right seat back is against the right seat base;

pivoting the left frame upwardly in a clockwise motion toward the center frame to a collapsed position such that the left seat back is substantially adjacent to the center seat base and the left seat base is positioned perpendicular to the center seat base; and pivoting the right frame upwardly in a counterclockwise motion toward the center frame to a collapsed position such that the right seat back is substantially adjacent to the center seat base and the right seat base is positioned perpendicular to the center seat base.

* * * * *